US005463715A

United States Patent [19]

Gagnon

[11] Patent Number: 5,463,715

[45] Date of Patent: Oct. 31, 1995

[54] METHOD AND APPARATUS FOR SPEECH GENERATION FROM PHONETIC CODES

[75] Inventor: Richard T. Gagnon, Highland, Mich.

[73] Assignee: Innovation Technologies, Hartland, Mich.

[21] Appl. No.: 998,459

[22] Filed: Dec. 30, 1992

[51] Int. Cl.[6] ..... G10L 9/00

[52] U.S. Cl. ..... 395/2.76; 395/2.67

[58] Field of Search ..... 381/51–53, 35, 381/43; 395/2.67, 2.7–2.78

[56] References Cited

U.S. PATENT DOCUMENTS

| | | | |
|---|---|---|---|
| 3,836,717 | 9/1974 | Gagnon | 179/15 A |
| 3,908,085 | 9/1975 | Gagnon | 179/15 G |
| 4,214,125 | 7/1980 | Mozer et al. | 179/15 M |
| 4,264,783 | 4/1981 | Gagnon | 395/2.7 |
| 4,301,328 | 11/1981 | Dorais | 179/15 A |
| 4,433,210 | 2/1984 | Ostrowski et al. | 395/2.74 |
| 4,685,135 | 8/1987 | Lin et al. | 381/52 |
| 4,692,941 | 9/1987 | Jacks et al. | 381/52 |
| 4,813,076 | 3/1989 | Miller | 381/43 |
| 4,829,573 | 5/1989 | Gagnon et al. | 395/2.7 |
| 4,833,718 | 5/1989 | Sprague | 381/52 |
| 4,872,202 | 10/1989 | Fette | 381/52 |
| 4,888,806 | 12/1989 | Jenkin et al. | 381/35 |
| 4,979,216 | 12/1990 | Malsheen et al. | 381/52 |
| 5,111,505 | 5/1992 | Kitoh et al. | 381/51 |

OTHER PUBLICATIONS

"Votrax Real Time Hardware for Phoneme Synthesis of Speech" by: Richard T. Gagnon pp. 175–178, IEEE, Jun. 1978.

*Primary Examiner*—Allen R. MacDonald
*Assistant Examiner*—Michelle Doerrler
*Attorney, Agent, or Firm*—Young, MacFarlane & Wood

[57] ABSTRACT

Speech generation from phonetic code is carried out by a microcomputer based system which stores digitized waveform segments and appropriately joins the segments and outputs them to a digital to analog converter and then to a speaker. An allophone is generated for each phoneme designated by the phonetic codes according to the articulation type of each adjacent phoneme. Each phoneme is classified as neutral, labial, glottal, or medial according to its effect on the articulation of adjacent phonemes. Each phoneme is characterized by at least one center waveform dependent on the phonetic code, and an initial waveform and a final waveform, each of which depend on the phonetic code and the articulation type of the neighboring phoneme. Tables of waveform pointers are accessed according to phonetic code and articulation type, and other tables provide articulation types, times of each waveform portion, transition rate, fricative state, and pitch for each phonetic code. Adjacent waveforms are gradually blended together. Continuously varying center waveforms are afforded by indexing through successive waveform pointers at a given rate during the center phoneme period, the rate and the period being retrieved from the tables.

29 Claims, 7 Drawing Sheets

FIG - 9
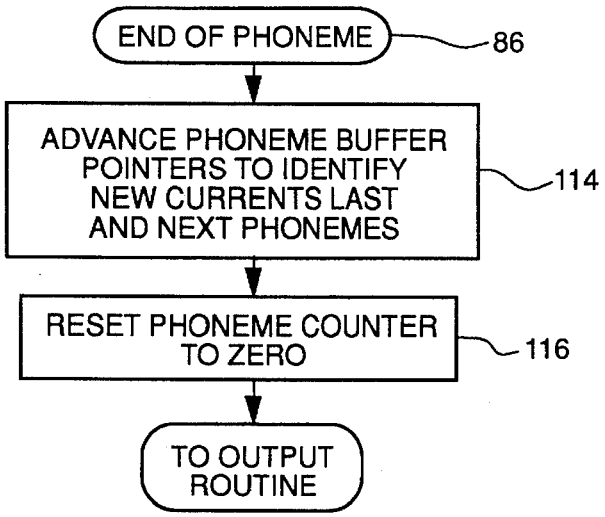
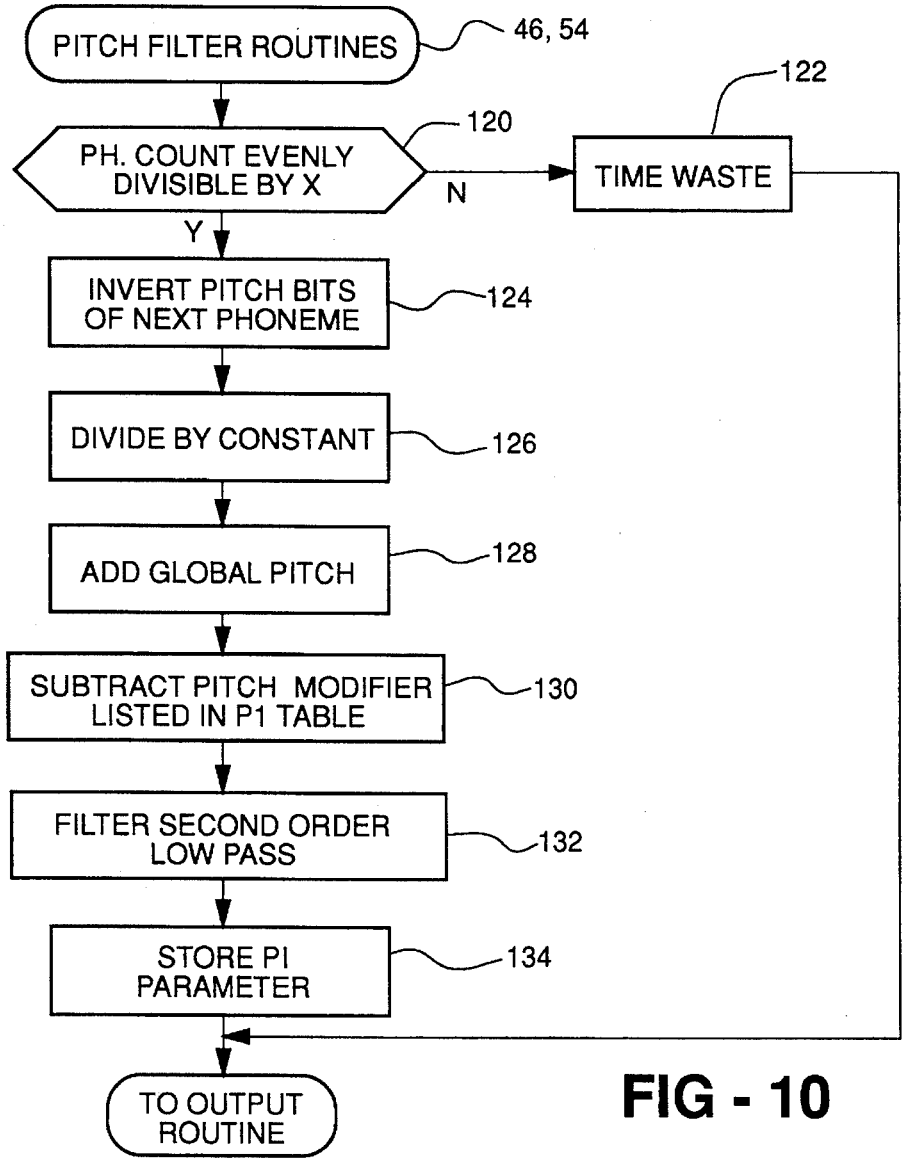
FIG - 10

METHOD AND APPARATUS FOR SPEECH GENERATION FROM PHONETIC CODES

FIELD OF THE INVENTION

This invention relates to the generation of speech and particularly to a method and apparatus for generating speech from phonetic codes.

BACKGROUND OF THE INVENTION

Much work has been done on electronic speech synthesis and generally has resulted in systems requiring huge amounts of memory and/or having only a small vocabulary. It is preferred, on the other hand to have an unlimited vocabulary and to carry out the generation of good, intelligible speech with the smallest possible amount of hardware.

Artificial speech systems fall into two categories. The first is a vocal tract system which attempts to emulate the human vocal tract by the use of variable filters to generate sounds representing the basic sounds within speech. The second is a waveform system which records speech samples and pieces them together as needed to reconstruct a given utterance. Either case requires that some type of input be interpreted as words, and because of the wide variety of word sounds, it has been proposed to amass large electronic libraries of all words or word portions which serve as building blocks of speech, and to draw upon them to construct an output. Such an approach is expensive in terms of the amount of hardware required for storage. Much has been written about data compression to reduce storage, but the storage of the required amount of compressed data for an unlimited vocabulary is still a formidable problem.

Speech can be divided into sound building blocks called phonemes. A word may be constructed of a few phonemes smoothly connected together. Many phonemes, chiefly vowel sounds, are dependent on context and thus have a number of variations called allophones. Speech based on basic phonemes without the variations sounds strange due to poor articulation and is sometimes unintelligible. Proposals to store all possible allophones result again in major storage problems. Other schemes using diphones to resolve contextual variations result in very large numbers of diphones and require even greater storage.

Whenever digitized waveforms are used, the prior processes for concatenating them generally result in highly objectionable discontinuities. While there have been attempts at smooth amplitude blending, they have largely been ineffective at least for some transitions such as fricative boundaries.

SUMMARY OF THE INVENTION

It is the purpose of this invention to achieve good intelligible sound quality with natural articulation by a small general purpose microcomputer chip. Such a chip may have a memory of 12K for example, and stores all the digitized waveforms needed for the English language and accommodates all the information and operating program needed for such speech, although it is equally applicable to any language and any dialect as well as for any speaker. The digitized waveforms are stored as small segments and when retrieved they are repeated as many times as dictated by the duration of the output waveform and at a rate which achieves the desired pitch. The computer functions are organized for very fast and powerful operation.

A high level of natural articulation and intelligibility is achieved by generating allophones having coarticulators dependent on adjacent phonemes. The coarticulators are initial and final waveforms which are selected based on the main phoneme and the articulation types of the preceding and following phonemes. When the initial, center and final waveforms are concatenated by gradual amplitude blending, a natural sounding allophone is generated, and complete intelligible utterances are produced by blending the adjacent allophones. Objectionable discontinuities at the junction of waveforms is avoided by gradual byte-by-byte replacement of one waveform by the next, using a controlled replacement rate wherein each byte of the new waveform is blended with the corresponding byte of the old waveform.

It has been discovered that the neighbor phoneme affecting the articulation of a vowel (or other phoneme) are of four articulation types: 1) glottal—g, k, rig; 2) medial—n, d, t; 3) labial—m, b, v, f; and 4) neutral—no adjacent consonant. All the members of each type have the same effect on each vowel. Thus each vowel and some other phonemes are context sensitive and the effect of a neighbor phoneme is easily predictable, depending on the articulation types.

The computer uses a very efficient method of generating speech output which requires that only the phonetic code for each phoneme be entered, and context sensitive waveforms are selected by rule driven look-up tables. Three consecutive phonetic codes are held in a buffer and the full articulation of the center phoneme is generated by appending to the center phoneme waveform an initial waveform which according to the articulation type of the preceding phoneme, and a final waveform according to the type of the next phoneme, thereby generating the allophone which is appropriate in the context. Only 70 waveforms (including pauses) are required for complete speech. Over a thousand combinations are possible by selecting from four initial and four final waveforms for each central waveform.

The microcomputer data is structured in tables. For each phoneme to be entered, the tables contain all the information for the central waveform pointers, the initial and final waveform pointers for each articulation type, the time duration of the central and final waveforms, the pitch of the waveform, the transition rate, and fricative quality. The microcomputer rapidly looks up the parameters for each entered phoneme, selects the proper initial and final waveforms, retrieves the waveforms, smoothly joins them, and drives a speaker via a D/A converter.

A major feature is the method of generating phonemes, such as a long i, which continuously vary in waveform throughout its expression such that, even apart from the co-articulation issue, merely repeating the central waveform for the duration of the vowel is not adequate. For such a phoneme, a plurality of waveforms are stored in memory and during the time of the central waveforms the waveforms are generated in sequence by indexing through the memory starting at the address of the first one. The time tables specify the duration of a central waveform and the time of initiating the final waveform. If the central waveform duration is set to a value larger than the time of initiating the final waveform, the waveform first retrieved for the central waveform will continue until the final waveform begins. By setting the central waveform duration to a value small enough to expire before the final waveform begins, a new central waveform is selected by indexing to the next pointer location. In this manner two or more central waveforms may be evoked automatically using the same software routine as used for all other phonemes.

BRIEF DESCRIPTION OF THE DRAWINGS

The above and other advantages of the invention will become more apparent from the following description taken in conjunction with the accompanying drawings wherein like references refer to like parts and wherein:

FIGS. 4, 6–10, and 12–13 are flow charts illustrating the program for carrying out the method of the invention;

DESCRIPTION OF THE INVENTION

Figure 1:
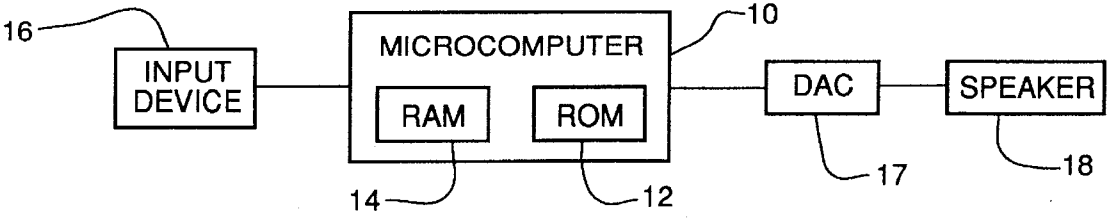
FIG. 1 is a block diagram of a speech generator which, when suitably programmed, carries out the invention.

The apparatus of the invention, as indicated in FIG. 1 is based on a general purpose microcomputer 10 having a ROM 12 for storing operating code, waveforms and parameters needed for generating speech and RAM 14 for execution of operating code and for a buffer of input code. Input commands, comprising a string of phonetic codes, are preferably entered from a separate input device 16, although if desired the phonetic codes needed for the speech generation could also be generated from the microcomputer in response to text or other input. The microcomputer output comprises a series of digitized waveforms which are fed to a digital to analog converter 17 to provide audio signals to a speaker 18.

Speech in any language can be broken down into a relatively few basic sounds. In English about 60 or so sounds are sufficient for constructing speech having an unlimited vocabulary. Very short segments of speech are recorded and stored as digitized waveform segments for recall. The speech generator described here determines the sequence of waveforms to play, the duration and pitch of each waveform, and the smooth blending of adjacent waveforms. The short waveform segments are repeated many times to reconstruct an output waveform of desired length. The repetition rate of the segments is adjusted to determine pitch.

An input message to be spoken by the speech generator is in the form of a phonetic code which specifies each phoneme in the message including breaks or pauses which are treated like phonemes. The number or phonemes in a word is roughly about the same as the number of letters in the word. The word "cat" has three phonemes, one for each consonant and one for the vowel. An input message for that word would comprise three phonetic codes representing the phonemes for k, short a, and t, respectively. A stress or pitch value is an adjunct of the phoneme identification and forms part of the phonetic code. Preferably the code is a single byte which uses six bits to identify the phoneme and two bits for pitch. One skilled in speech generation can manually compose messages in phonetic code for input to the generator. Other sources for the code may be used as well; for example, known text-to-speech generators can determine phonetic codes. In that case the present speech generator can be integrated with a program for generating the codes from text.

Many phonemes, especially vowels, are context sensitive and assume different forms, called allophones, depending on the influence of adjacent phonemes. Proper articulation depends on using the correct allophone for the context of the phoneme. Thus the short a in "cat" has a sound which depends on the c and the t and is different from the short a in the words "bat" and "cap". Each consonant is classified as glottal, medial or labial articulation type which affect the adjacent phonemes, and a vowel or pause is here considered to be a neutral articulation type since it normally has no effect on its neighbor. All phonemes of a given type have the same effect on given adjacent phonemes. This fact is used to design a compact program for generating each allophone from a basic phoneme and a knowledge of the articulation types of its neighbors.

Figure 2:
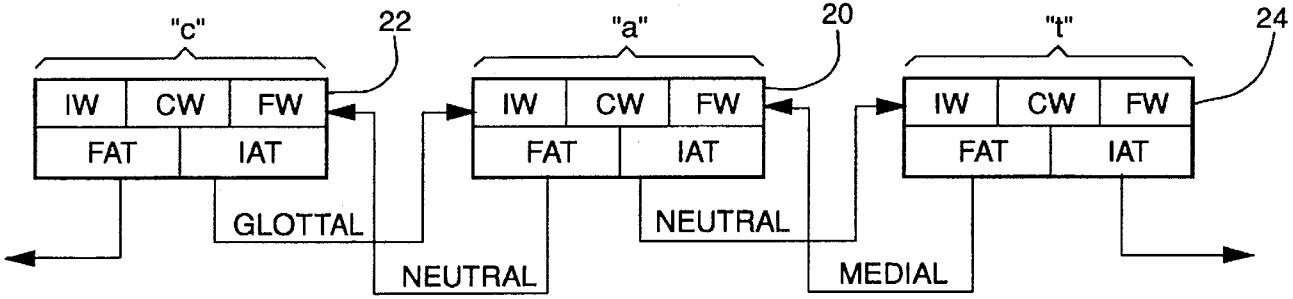
FIG. 2 is a diagram illustrating context sensitive allophone generation according to the invention.

As shown in FIG. 2, a phoneme 20 has at its center a basic or center waveform CW, a leading portion or initial waveform IW, and a trailing portion or final waveform FW. It should be understood, however, that some phonemes, such as a long A or long I, have varying center waveforms which are represented in this speech generator by a succession of two to four different waveforms. The initial and final waveforms IW and FW may have the same waveform as the center (if there is only one center waveform) or they may be different. If the initial waveform is different it depends on the initial articulation type of the preceding phoneme 22; if the final waveform is different it depends on the final articulation type of the following phoneme 24. Thus a group of three consecutive phonetic codes is required to determine the allophone corresponding to the center phoneme. For the first or last phonetic code of an utterance the neighbor is assumed to be a pause, or neutral type.

Using the word "cat" for an example, the center phoneme 20 is short a and the preceding and following phonemes 22 and 24 are c and t. The vowel a is neutral and has no effect on the neighbors 22 and 24. The c is glottal articulation type and an initial waveform IW is selected for phoneme 20 as the glottal initial form of short a. The t is a medial articulation type and a final waveform FW is selected for phoneme 20 as the medial final form of short a. Thus an allophone is constructed for phoneme 20 which will be the same in waveform for any occurrence of short a bounded by a preceding glottal phoneme and a following medial phoneme, although the pitch may be different depending on the pitch modifier in the phonetic code. In a few cases, such as in some fricative stops, the phoneme may not be symmetrical as to articulation type. That is, its effect on a preceding phoneme may be different than its effect on a following phoneme. To accommodate this case, two articulation types are assigned to each phoneme—initial articulation type (IAT) and final articulation type (FAT).

Figure 3:
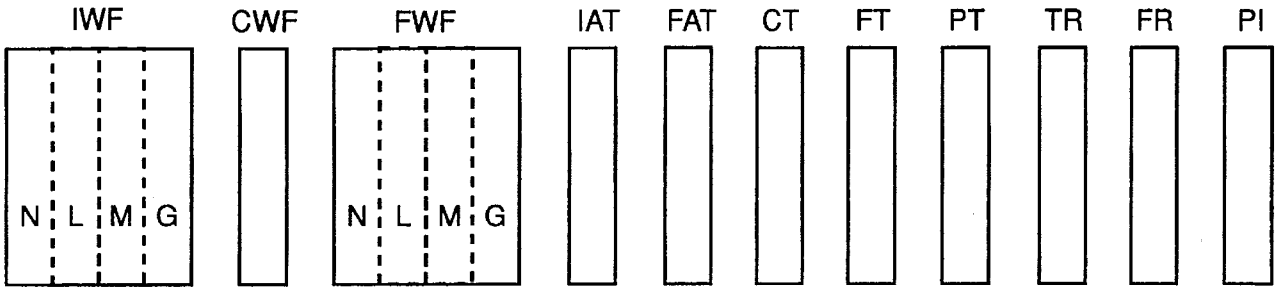
FIG. 3 is a map of tables embedded in the speech generator of FIG. 1.

The implementation of speech requires more than waveform selection. The time duration of each waveform, the transition between adjacent waveforms, the generation of unvoiced phonemes or fricatives, pitch of each phoneme and pitch transition are also important. To provide all that information in a microcomputer and have it readily available, it is organized in tables which are embedded in ROM. Such tables are represented by FIG. 3 wherein waveform pointers for initial, center and final waveforms are arrayed in tables IWF, CWF, and FWF, respectively, with the IWF and FWF tables being divided into the four articulation types N, L, M, and G. Parameters associated with each phoneme are listed in other tables called IAT and FAT for initial and final articulation types, CT, FT, and PT for the time durations of waveforms, TR for transition rate parameter, FR for fricative type, and PI for pitch. Thus given a particular phoneme code, the center waveform and all the possible initial and final waveforms can be identified by waveform pointers which ultimately address memory locations of the digitized waveforms. Similarly, the articulation type, timing, transition rate, fricative type and pitch are identified for each phoneme code.

Figure 4:
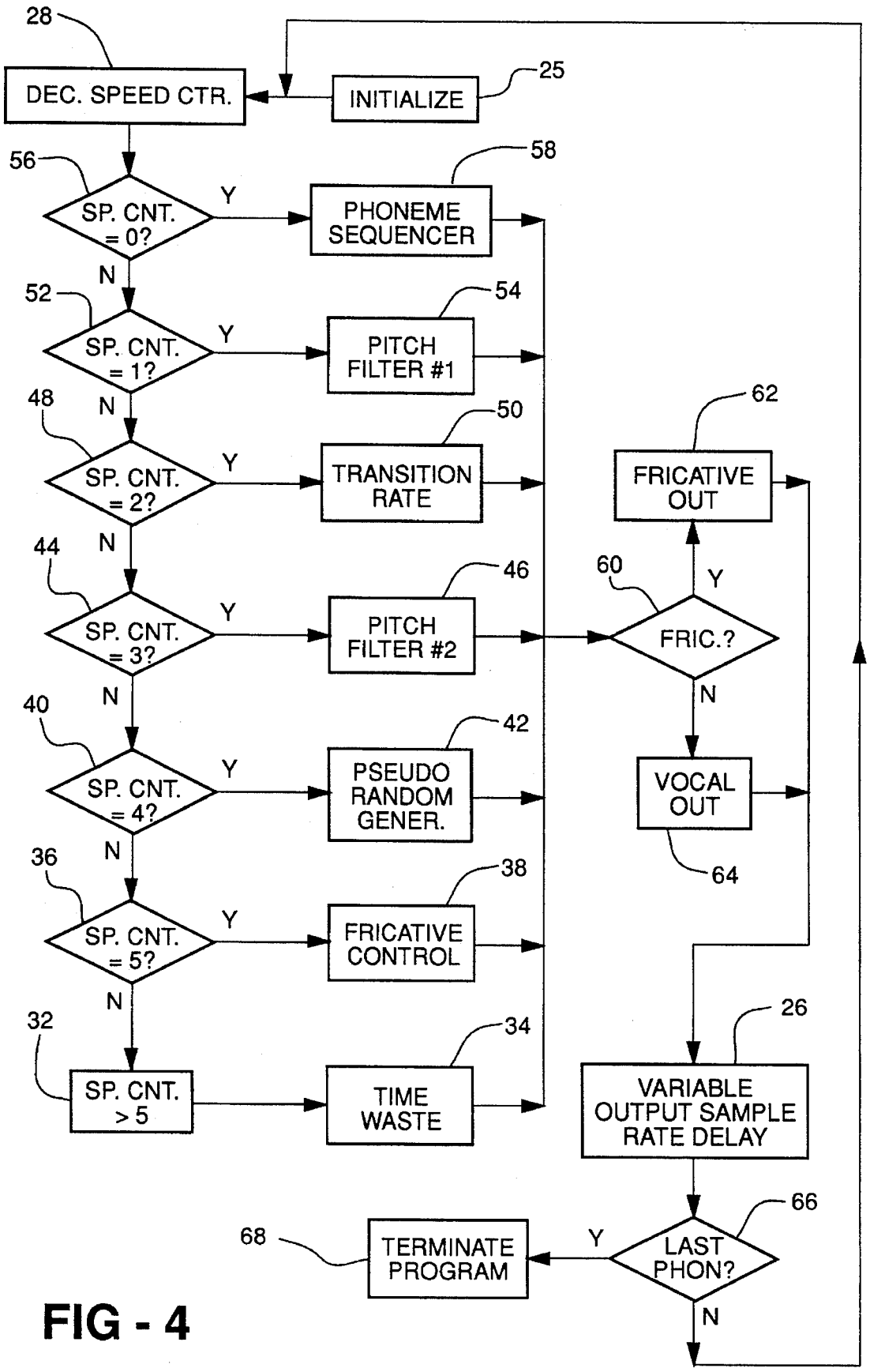

The speech generation program is generally represented by the functions set forth in flow charts beginning at FIG. 4. In the description of the flow charts, numerals in angle brackets <nn> refer to functions associated with blocks identified by the same reference numerals. The program has an input section which initializes the program <25>, then identifies the waveforms to be output to generate each allophone and develops the phoneme parameters, and an output section which retrieves and smoothly blends the waveforms to produce a digitized speech output.

The input section has many paths or branches, all of which are designed to take the same amount of time, and similarly the output section has plural branches which take the same amount of time to execute, so that each complete pass through the program uses the same time regardless of the functions being processed. The output does, however, have a variable output sample rate delay 26 which is a program controlled time delay, allowing an adjustment of the time required in each pass, thereby affecting speech rate and pitch, and more importantly, the output sampling rate—the rate at which waveform segments are retrieved and output. In general the program executes at the rate of about 12 KHz.

The input section has a speed counter 28 which is decremented at every pass and when it reaches zero it is reset to a global speed parameter which may be on the order of 30. Selection of that speed parameter affects speech rate by determining the rate of processing phonemes, but pitch is not affected. The work on the input section is accomplished in only a few passes, while the output section requires many more passes for the real time generation of the speech output. Thus for speed counts greater than 5 <32>, the program enters a time waste path 34, where the required amount of time for input routines is consumed. At a speed count of 5 <36>, a fricative control routine 38 is entered for setting a fricative flag if the current phoneme is a fricative. At count 4 <40>, a pseudo-random generator routine 42 is entered for producing random numbers for use in generating fricative output waveforms. At speed count of 3 <44>, a pitch filter routine 46 is entered to low pass filter a pitch parameter previously generated by routine 54. At speed count of 2 <48>, a transition rate routine 50 is entered for selecting a filter rate for transitions between the current waveform and the next waveform. At speed count of 1 <52>, another pitch filter routine 54 is entered to develop the pitch parameter which is further filtered in routine 46. Finally, at speed count of 0 <56>, a phoneme sequencer routine 58 is entered wherein the string of phonetic codes is read, and waveforms are selected to construct each allophone.

The output section determines whether a fricative flag is set <60>, and if so a fricative output routine 62 is entered for generating a fricative waveform from the selected waveform by the use of the random numbers from routine 42 to avoid periodic repetition of the waveform. The fricative output routine 62 also effects transition of the fricative waveform according to the transition rate from routine 50. When the fricative flag is not set <60>, a vocal output routine 64 is entered for retrieving the current vocal phoneme, controlling its pitch according to the pitch rate from pitch filter routine 46, and its transition rate. Each of the fricative and vocal routines 62, 64 passes its waveform output to the DAC 17 to activate the speaker 18. After the routines 62, 64, the program passes to the variable delay 26 and then, if it is not the last phoneme <66>, loops back to speed counter decrement routine 28, as indicated by the node A. If it is the last phoneme <66>, the program is terminated <68>.

Figure 5A:
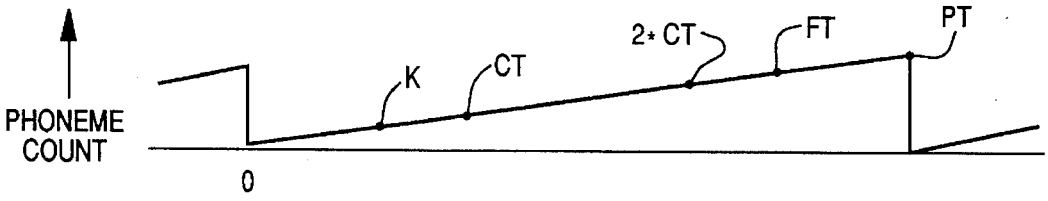
FIGS. 5A and 5B are diagrams of phoneme counter content and the timing of waveform selection, respectively.
Figure 5B:
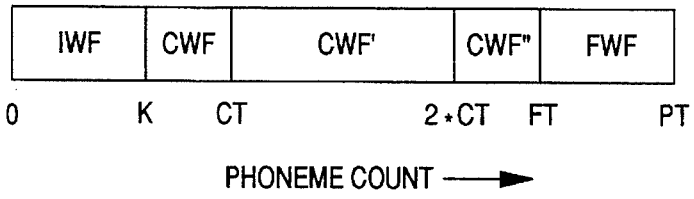
Figure 6:
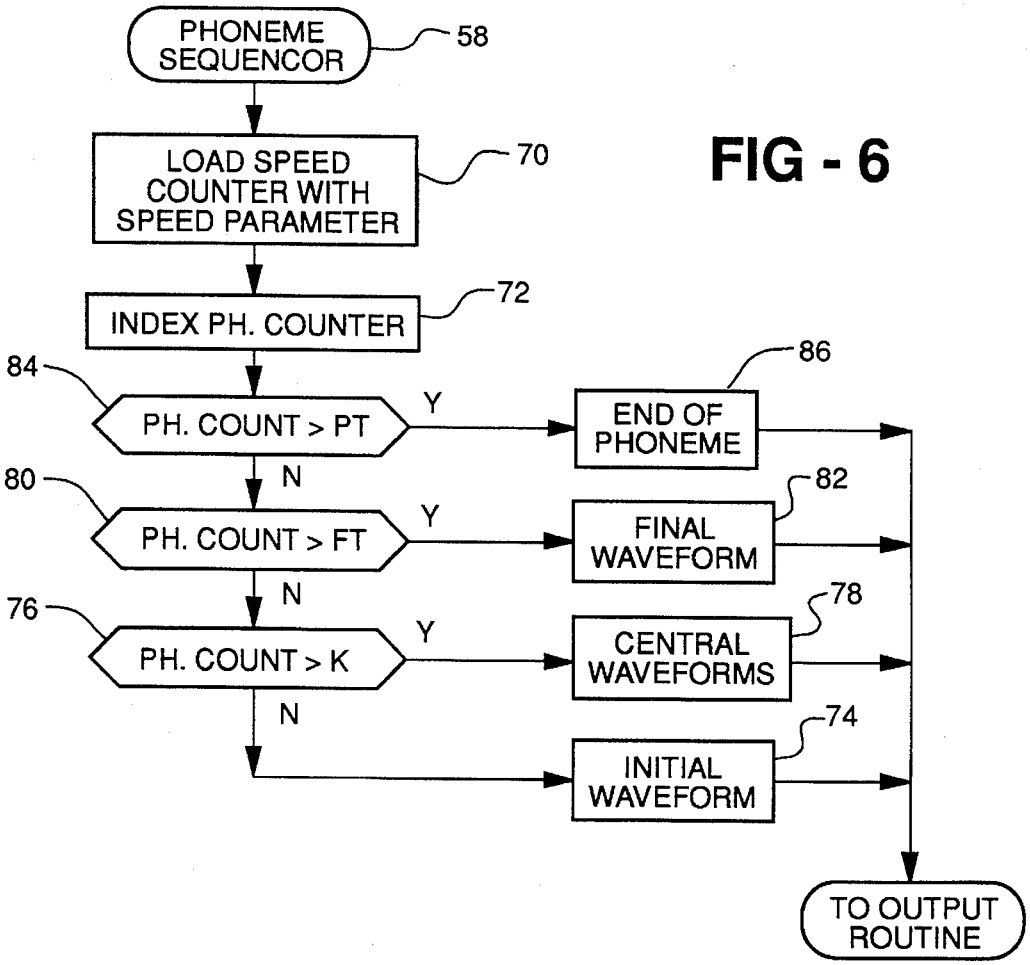

FIGS. 5A and 5B graphically illustrate the timing of the phoneme sequencer routine 58. A phoneme counter is indexed at each pass through the phoneme sequencer routine, and the duration of each waveform of the generated allophone is determined by the phoneme counter and the tables of times CT, FT and PT, along with a fixed time K which could, if desired, also be made into a variable. For the current phoneme the times are read from the tables. The counter starts at zero at the beginning of each phoneme and increments stepwise, although a straight line is used to illustrate the phoneme count. An initial waveform IWF begins at 0 and ends at the fixed time K. The center waveforms CWF begin at K and end at FT, and the final waveform runs from FT to the end of the phoneme PT. This activity is shown in the flow chart of FIG. 6. First, the speed counter is loaded with the speed parameter <70>, and then the phoneme counter is indexed <72>. For phoneme counts less than K the initial waveform is generated <74>. When the count exceeds K <76>, central waveforms are generated <78>, but when the counts exceeds FT <80>, the final waveform is produced <82>. The final waveform ends when the count exceeds PT <84> and an end of phoneme routine is executed <86>.

Figure 7:
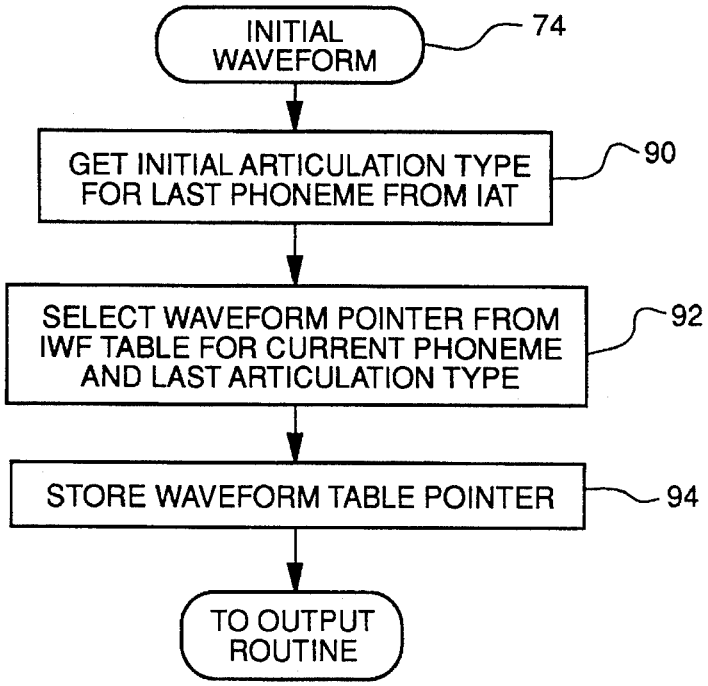

As shown in FIG. 7, the initial waveform routine 74 comprises looking in the initial articulation table IAT, shown in FIG. 3, to determine the initial articulation type (N, M, G, L) of the phoneme preceding the current phoneme in the phonetic code string <90>, then, based on that articulation type and the current phoneme, select the waveform pointer from the IWF table of FIG. 3 <92>. The retrieved pointer is stored for use by the output section <94>.

Figure 8:
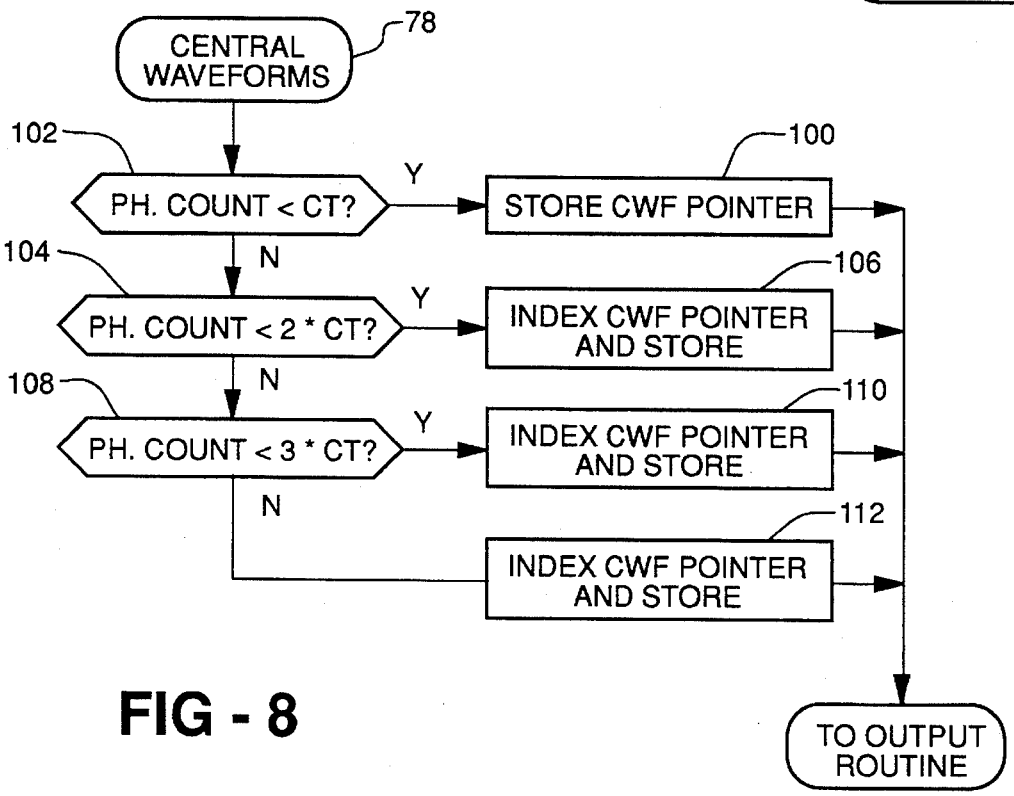

The central waveforms routine 78 has the capability of sequentially indexing to a plurality of waveform pointers in order to progressively change the center waveform, providing the waveform interval CT is smaller than the count FT for beginning the final waveform. The waveform pointer can index up to three times if the count FT is sufficiently large to accommodate that many CT intervals. As shown in the example of FIG. 5B, the first center waveform CWF starts at K and continues to CT, the second one CWF' runs from CT to 2*CT, and a third waveform CWF" extends to the count FT. For most phonemes, it is not desired to so change the center waveform and the interval CT is chosen to be larger than FT. As shown in FIG. 8, the central waveforms routine 78 stores the CWF pointer <100> if the phoneme count is less than CT <102>. When the phoneme count becomes larger than CT <102> and is less than twice CT <104>, the pointer is indexed to the next pointer address <106>. When the count exceeds twice CT <104> and is less than three times CT <108>, the pointer indexes again <110>. Finally if the count exceeds three times CT, the pointer is indexed a third time <112>.

The final waveform routine 82 is essentially the same as the initial waveform routine 74, except that the final waveform articulation type for the following phoneme is located in the FAT table, and the final Waveform pointer is then retrieved from the FWF table.

The end of phoneme routine 86 comprises advancing the buffer pointer to get the new phoneme for the current position as well as new phonemes for the last and the next phonemes <114>. Then the phoneme counter is reset to zero <116>.

The pitch parameter controls waveform repetition rate and thus pitch. Three inputs determine the pitch parameter. A stored global pitch sets the base pitch. Each voiced phoneme has a pitch modifier stored in the PI table of FIG. 3, and a 2 bit pitch notation is added to each input phonetic code to reflect pitch or stress as required by the context of the particular message. The pitch modifier table is constructed on the basis that generally a certain relative pitch is associated with each type of phoneme. These types of phonemes, in order or decreasing pitch, are: 1) long duration long vowels, 2) short duration long vowels, 3) long duration short vowels, 4) short duration short vowels, 5) voiced consonants, 6) unvoiced consonants, and 7) pauses. While pitch assignments do not directly affect unvoiced consonants and pauses, they do affect the pitch transition between voiced waveforms and the unvoiced waveforms or pauses.

The pitch filter routines 46 and 54 are integrated into the flow chart of FIG. 10. Separate routines are used in the program because of time constraints. Functionally they work together to yield a single pitch parameter PI for the current phoneme, so that pitch transition from one phoneme to the next can be carried out gradually. A pitch parameter PI is developed for each phoneme from the three pitch inputs and filtering determines the rate of change. The 2 bit pitch notation is written with high values reflecting high pitch and is inverted by the program which requires that a high pitch be represented by a low number corresponding to a short waveform period, and vice versa. To control the filter rate, the routine is run only a limited number of times during each period of the phoneme counter. Thus if the phoneme count is not evenly divided by some integer X <120>, a time waste branch is entered <122>. Otherwise the pitch bits of the next phoneme are inverted <124> and divided by a constant <126>. The global pitch is added <128> and the pitch modifier is subtracted <130>. Then the resultant parameter is twice filtered by a low pass filter <132> to prevent sudden pitch change to produce the pitch parameter PI which is stored for use by the vocal output routine 64.

The transition rate routine 50 selects one of four numerical tables for use with a filter in the output section. The tables are preferably are for the functions divide by 4, divide by 2, divide by 1, or 0, but any desired values can be stored in the tables according to the desired transition effect. The TR table of FIG. 3 stores a number for the initial, center and final waveforms for each phoneme. Thus the routine 50 looks up the number for the waveform being processed and selects the corresponding numerical table.

The pseudo-random generator routine 42 produces two target numbers which change with every pass. The numbers are used in conjunction with fricative waveform pointers which retrieve waveform bytes in sequence from a stored fricative waveform. In any given sweep through the stored waveform the pointer excursion begins at a random target location in the lower range of the pointer travel, increments to a random target location in the higher range and reverses direction. The routine 42 chooses a pseudo-random number, subtracts it from the upper limit of the pointer range and stores the result as the high fricative target, and adds it to the low limit of the pointer range and stores that result as the low fricative target.

The fricative control routine 38 looks up fricative flag bits in the FR table in ROM. A fricative flag is stored in the FR table for each of the initial, center and final waveforms of each phoneme. The flag for the currently processed waveform is retrieved and used by decision block 60 for determining the operation of the output section.

Figure 11:
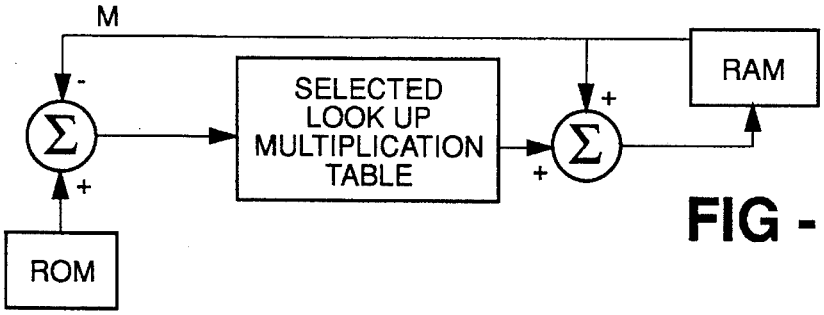
FIG. 11 is a diagram of transition filter operation, according to the invention.

In the output section the fricative output routine 62 loads a selected waveform into RAM from its ROM location using a byte pointer which updates at each pass or resets when it comes to the highest byte location of the waveform. The transition filter filters the waveform in memory by limiting the rise time, using the selected numerical table, to blend the adjacent portions of consecutive waveforms. The transition filtering or byte filtering is filtering in time slots which are repetitive from waveform to waveform. Byte filtering occurs, as shown in FIG. 11, by reading a byte from ROM and a corresponding byte from RAM, taking the difference, multiplying the difference by a fraction (using one of the numerical tables to look up the fractional product), and adding the product to the original byte in memory, replacing the original byte. Thus, during a few passes of the byte pointer the old waveform is gradually replaced by the new one. A fricative pointer moving back and forth across the RAM between end points determined by the pseudo-random generator reads fricative bytes from the RAM and passes them to the DAC 17 for driving the speaker. The pseudo-random reading technique avoids periodicity in the fricative output which can cause a buzz in the output.

Figure 12:
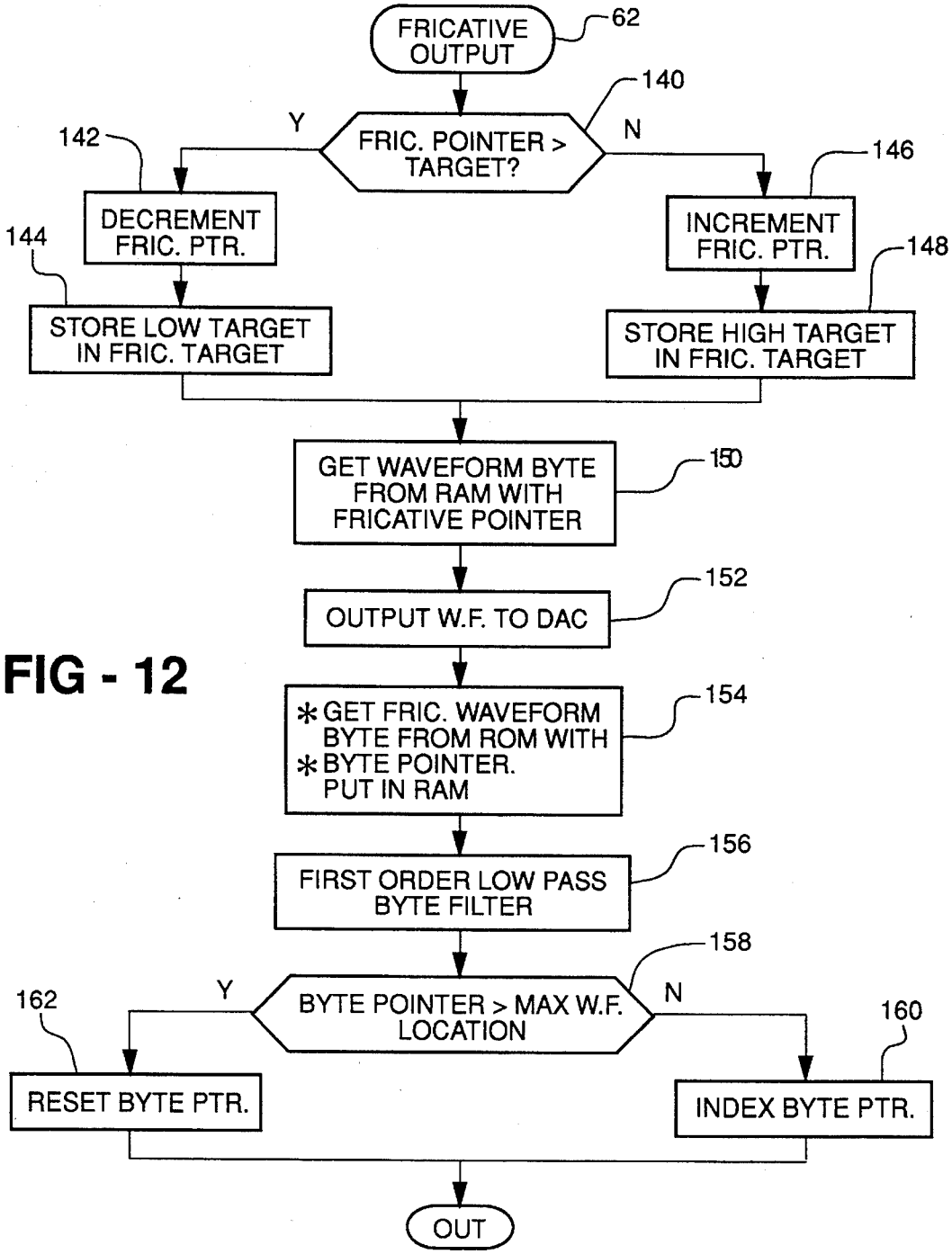

As indicated in FIG. 12, the order of the RAM writing and reading function can be reversed. The fricative output routine 62 starts with control of the fricative pointer for reading from RAM. IF the pointer is above the target <140> the pointer is decremented <142> and the low target from the pseudo-random generator 42 is stored as the fricative target <144>. As long as he pointer remains above the target new values of the target continue to be generated and stored it the fricative target. When the fricative pointer is not above the target <140>, the pointer is incremented <146> and the generated high target is stored in the fricative target <148>. Using the continuously indexing fricative pointer the waveform in RAM is retrieved a byte at each pass <150> and output to the DAC <152>. Using the byte pointer the fricative waveform is copied from ROM to RAM <154> and low pass filtered <156>. If the byte pointer is pointing to a waveform location in ROM <158> the pointer is indexed <160>, but if it exceeds a waveform location <158> the pointer is reset to the beginning of the waveform <162>.

The vocal output routine 64 byte filters a selected waveform retrieved from ROM one byte at a time, as described above and depicted in FIG. 11, and outputting the filtered byte to the DAC 17 as well as storing it in RAM. A new waveform is selected by updating the waveform pointer when the byte pointer is reset to assure a change when the waveform energy is small, and at the next pass the transition parameter is updated. Forcing these changes to occur at low energy points avoids popping due to discontinuities in the resulting waveform.

Figure 13:
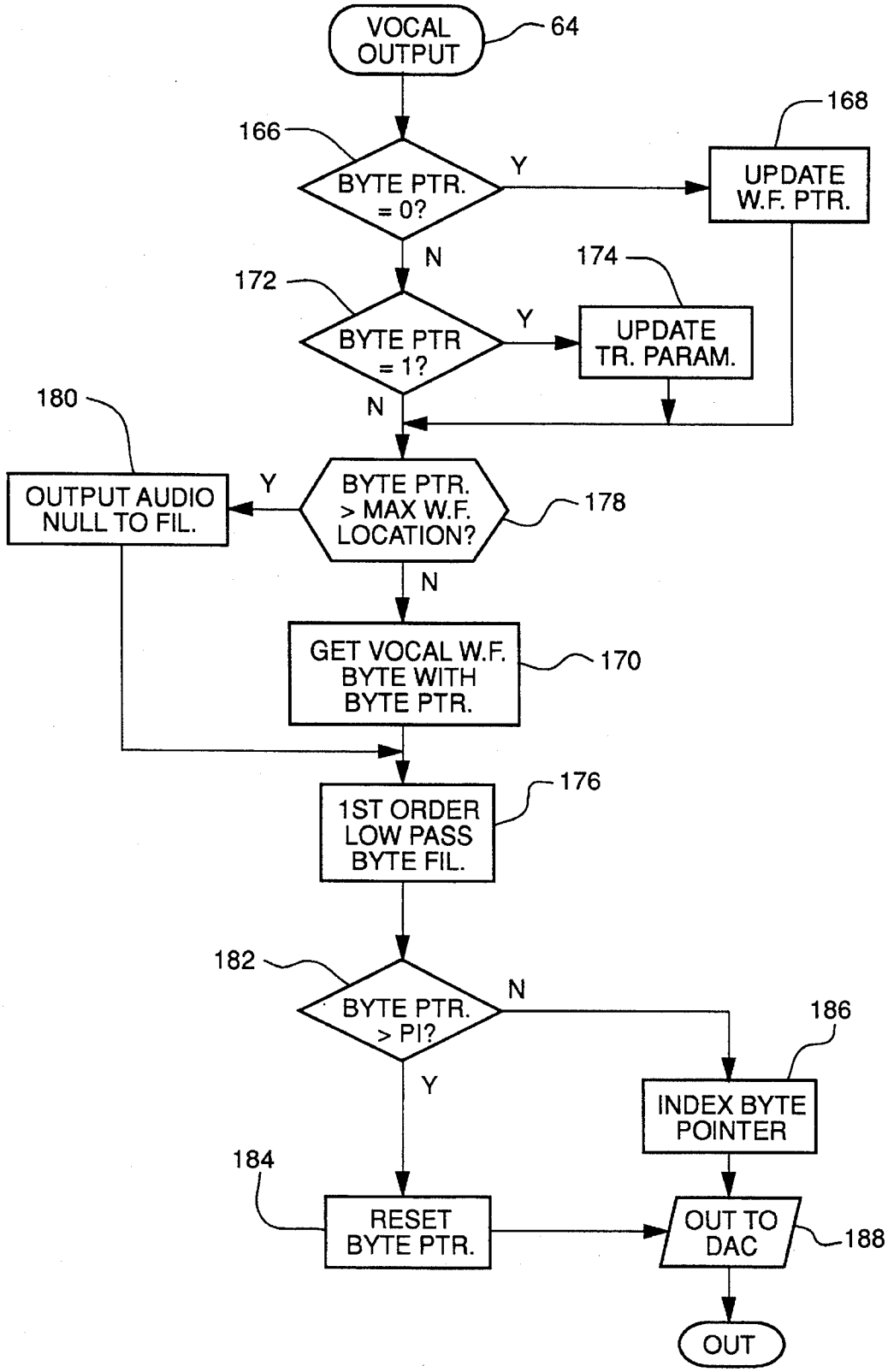

The routine 64 is shown in FIG. 13. When the byte pointer is zero <166> the waveform pointer is updated <168> to the value stored by the phoneme sequencer routine 58, and then a vocal waveform byte is retrieved from ROM by the byte pointer <170>. If, instead, the byte pointer equals 1 <172>, the transition parameter is updated <174> and the program goes to block 170. Otherwise the routine flows to block 170 and then to the transition filter block 176, except when the byte pointer exceeds the maximum waveform location <178>; then a null value is input to the filter <180>. Then if the byte pointer is greater than the pitch parameter PI <182> the pointer is reset <184>, or if it is not greater than PI the byte pointer is indexed <186> and the filtered byte is passed to the DAC 17 <188> to complete the vocal output routine.

It will thus be seen that the method and apparatus of the invention provides a real time system of speech synthesis requiring minimal hardware and a very small but efficient operating program. The technique of storing waveform pointers and parameters in tables results in a rule driven machine requiring extremely few computations. The speech generator is readily operated with an inexpensive general purpose microcomputer chip using 12 Kilobytes of ROM and less than 512 bytes of RAM.

The embodiments of the invention in which an exclusive property or privilege is claimed are defined as follows:

1. The method of generating speech comprising the steps of:

storing a plurality of digitized waveforms representing phonemes of voiced and fricative types;

assigning an articulation type to each phoneme;

inputting a series of phonetic codes representing speech wherein the series of phonetic codes identify a succession of phonemes;

for each phonetic code, generating an allophone by selecting at least one stored digitized center waveform corresponding to such phonetic code, selecting a stored digitized initial waveform according to the articulation type of the preceding phoneme in the succession, selecting a stored digitized final waveform according to the articulation type of the following phoneme in the succession, and serially combining the selected initial, center, and final waveforms; and concatenating a series of allophones corresponding to the series of phonetic codes for producing a digital representation of the speech; and producing audible speech from the digital representation of speech.

2. The method as defined in claim 1 wherein the step of assigning an articulation type to each phoneme comprises identifying each phoneme as labial, glottal, medial or neutral in accordance with each phoneme's effect on the articulation of adjacent phonemes.

3. The method as defined in claim 2 wherein the step of assigning an articulation type includes assigning an initial articulation parameter and a final articulation parameter in accordance with each phoneme's effect on the articulation of adjacent preceding and following phonemes respectively.

4. The method as defined in claim 1 including the steps of:

storing tables of waveform pointers for each phoneme according to articulation type and for final and initial waveforms; and the steps of selecting each final waveform and each initial waveform comprise looking up the corresponding waveform pointers in accordance with the articulation type and the phonetic code.

5. The method as defined in claim 1 including the steps of:

storing tables of waveform pointers for each phoneme according to articulation type and for final and initial waveforms, and tables of waveform duration parameters for each phoneme; and wherein the step of producing a digital representation of the speech comprises incorporating each selected waveform for a period indicated by the tables of waveform duration parameters.

6. The method as defined in claim 1 wherein given phonemes have a plurality of center waveforms for sequential use and other phonemes have only a single center waveform, including the steps of:

storing tables of waveform pointers for center waveforms including for the given phonemes a plurality of pointers in sequential memory locations; and retrieving a sequence of center waveforms for such given phonemes by indexing through the sequential memory locations to recall the plurality of pointers.

7. The method as defined in claim 6 including the steps of:

storing tables of waveform intervals for center waveforms and of center expiration times;

retrieving center waveforms by selecting a corresponding stored waveform;

comparing the waveform interval and the center expiration time; and indexing to another waveform pointer when the waveform interval elapses prior to the center expiration time.

8. The method as defined in claim 1 including the steps of:

storing a transition rate parameter for initial, center and final waveforms for each phonetic code;

determining a filter rate from the transition rate for the waveform being processed; add low pass byte filtering the waveforms to smoothly blend successive waveforms.

9. The method as defined in claim 1 including the steps of:

storing pitch data for each phonetic code;

further including pitch data as a part of each phonetic code;

deriving a pitch parameter from the stored and the included pitch data; and repeating each selected waveform at a rate in accordance with the pitch parameter to thereby affect the pitch of the speech.

10. In a speech generation apparatus having a memory containing tables of waveform pointers and tables of phoneme parameters, the method of generating speech comprising the steps of:

storing in the memory digitized waveforms for use as initial, center and final waveforms;

inputting a phonetic code sequence representing speech;

repetitively and sequentially executing an input routine and an output routine for progressively processing phonetic codes;

on successive passes through the input routine entering branches for selecting from the tables waveform pointers, the waveform pointers identifying initial, center and final waveforms for a current phoneme; and on successive passes through the output routine, retrieving stored digitized waveforms in accordance with the selected waveform pointers, and generating a digital representation of speech corresponding to the phonetic code sequence by combining the retrieved waveforms.

11. The method as defined in claim 10 wherein the tables of phoneme parameters include the articulation type of each phoneme, the tables of waveform pointers include pointer addresses for different articulation types, and an input routine includes the steps of:

determining from the tables the articulation types of the phonemes preceding and following the current phoneme;

determining from the tables the initial waveform pointer according to the articulation type of the preceding phoneme and the final waveform pointer according to the articulation type of the following phoneme.

12. The method as defined in claim 10 wherein every pass through an input and a subsequent output routine requires the same total execution time, and wherein the output routine includes an adjustable time delay, the method including the step of:

adjusting the execution time by selecting a time delay in the output routine, whereby data sampling rate is adjusted.

13. The method as defined in claim 10 comprising the steps of:

counting the passes through both routines and indexing a speed counter for each counted pass;

setting a speed counter value and resetting the speed counter each time the number of counted passes equals the set speed counter value;

indexing a phoneme counter each time the speed counter resets;

entering each input routine's branch only once for each count of the phoneme counter;

entering a time waste path for each pass in which an input routine is not entered, whereby every pass through the input routine requires the same time.

14. The method as defined in claim 10 wherein one of the routines includes a speed counter indexed at each pass and being reset when a first count value is reached, and a phoneme counter indexed each time the speed counter is reset and being reset when a second count is reached, including the step of adjusting speech rate by selecting the first count value.

15. The method as defined in claim 14 including tables based on the phoneme counter of final waveform intitiation times and final expiration times for each phonetic code, and including the steps of:

during the time of the center waveform, selecting a waveform pointer corresponding to the current phoneme for retrieving final waveform initiation times and final expiration times;

when the phoneme counter reaches the retrieved final waveform initiation time, selecting a final waveform pointer, and subsequently terminating the final waveform at the final expiration time.

16. The methods as defined in claim 14 including tables of times based on the phoneme counter for initiating the final waveform, for terminating the phoneme for each phonetic code, and of center waveform indexing intervals, and wherein the waveform pointer tables include for certain phonemes a succession of waveforms, including the steps of:

during the time of the center waveform, selecting a waveform pointer corresponding to the current phoneme and whenever the indexing interval occurs before the final waveform initiation time, indexing the waveform pointer to a successive pointer; and when the phoneme counter reaches the final waveform initiation time, selecting a final waveform pointer.

17. The method as defined in claim 10 including the steps of:

for each waveform assigning a flag indicating whether the waveform is fricative or voiced;

on successive passes through the output routine, entering either a fricative routine or a voiced routine according to the flag.

18. The method as defined in claim 10 wherein the tables of phoneme parameters include transition rate parameters, including the steps of:

entering an input routine for determining a transition rate for each waveform from the tables of phoneme parameters; and in the output routine, determining filter characteristics from the transition rate for the new waveform and byte filtering adjacent waveforms using the filter characteristics.

19. The method as defined in claim 10 wherein the tables of phoneme parameters include pitch parameters and the input phonetic codes incorporate input pitch parameters including the steps of:

entering an input routine for determining an output pitch parameter from the tables of phoneme parameters and the input pitch parameters; and in the output routine, repetitively retrieving waveforms at a rate determined by the output pitch parameter.

20. The method as defined in claim 10 including the steps of:

storing a global pitch parameter; and in the output routine, repetitively retrieving waveforms at a rate determined by a function of the global pitch parameter.

21. The method as defined in claim 10 wherein every pass through an input and a subsequent output routine is completed in a selected execution time, the method including the step of:

adjusting the selected execution time by selecting a software time delay, whereby pass repetition rate is selected to adjust the data sampling rate.

22. The method as defined in claim 10 wherein one of the routines includes a speed counter indexed at each pass and being reset when accumulated counts equal a global speed parameter, including the steps of:

storing a global speed parameter; and adjusting speech rate by selecting the global speed parameter.

23. Apparatus for generating speech in response to input codes including:

a memory for storing phoneme waveforms and phoneme articulation types;

input means for receiving a string of phonetic codes representing speech;

context sensitive means for generating allophones for respective received phonetic codes including means for selecting center waveforms as dictated by corresponding phonetic codes and for selecting initial and final waveforms for each allophone according to the respective articulation types of preceding and subsequent phonemes;

waveform transition means for blending selected adjacent waveforms of each allophone and consecutive allophones; and output means responsive to the blended waveforms for producing audible speech corresponding to the input string.

24. The apparatus as defined in claim 23, wherein the memory stores the waveforms as waveform segments and the memory further stores pitch data for each phonetic code and the phonetic codes carry further pitch data, including:

means responsive to the stored pitch data and the further pitch data carried by the code for calculating a pitch parameter; and the output means includes means responsive to the pitch parameter for governing the repetition rate of waveform segments thereby affecting the pitch.

25. The apparatus as defined in claim 24 wherein the means for calculating a pitch parameter includes low pass filter means operating on the pitch parameter to smooth the transition of pitch parameter values between successive waveforms.

26. The apparatus as defined in claim 23 wherein the memory stores a transition rate for each phonetic code, and wherein:

the waveform transition means includes a filter for gradually blending adjacent waveforms; and means responsive to the stored transition rates for determining filter characteristics for each waveform.

27. Apparatus for generating speech in response to input codes comprising a microcomputer based apparatus including:

a buffer for holding a string of phonetic codes representing a succession of phonemes for at least a portion of desired speech;

a read only memory (ROM) containing operating code, a plurality of digitized waveforms, a table of articulation types for each phonetic code and addressable by the phonetic code, and tables of waveform pointers addressed by the phonetic codes and articulation types;

pointer means for successively designating each phonetic code, in turn, as a current phonetic code and for each current phonetic code designating a center phoneme, a preceding phoneme and a following phoneme;

means for looking up in the table of articulation types the types of the preceding and the following phonemes;

means for looking up the waveform pointers for the initial, center, and final waveforms for each current phonetic code, in turn using the articulation types and the phonetic code to define a succession of waveforms; and means for retrieving waveforms identified by the waveform pointers and joining the retrieved waveforms for each phonetic code to generate a string of context sensitive allophones representing the desired speech.

28. The apparatus as defined in claim 27 wherein the ROM contains a table of fricative states addressed by the phonetic codes;

means for generative a fricative phoneme from waveforms associated with a fricative state; and means for generating a voiced phoneme from waveforms not associated with a fricative state.

29. The apparatus as defined in claim 27 wherein the ROM contains a table of pitch modifiers addressed by the phonetic codes;

means for generating a pitch parameter for each phoneme;

low pass filter means for filtering the pitch parameters to prevent sudden changes of parameter value; and means for controlling waveform repetition rate dependent on the filtered pitch parameters.

* * * * *